US007263312B2

(12) United States Patent
Park

(10) Patent No.: US 7,263,312 B2
(45) Date of Patent: Aug. 28, 2007

(54) IMAGE FORMING APPARATUS HAVING SCAN UNIT AND CONTROLLING METHOD THEREOF

(75) Inventor: Kwang-sung Park, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 150 days.

(21) Appl. No.: 11/092,839

(22) Filed: Mar. 30, 2005

(65) Prior Publication Data

US 2005/0286929 A1 Dec. 29, 2005

(30) Foreign Application Priority Data

May 12, 2004 (KR) ..... 10-2004-0033309

(51) Int. Cl.
*G03G 15/00* (2006.01)

(52) U.S. Cl. ..... 399/124; 399/125; 399/405

(58) Field of Classification Search ..... 399/124, 399/125, 21, 107, 177, 118, 405
See application file for complete search history.

(56) References Cited

U.S. PATENT DOCUMENTS 4,596,456 A * 6/1986 Ide ..... 399/21 X
4,641,947 A * 2/1987 Ishida et al. ..... 399/125
5,532,826 A * 7/1996 Miyao et al. ..... 399/405 X
6,510,301 B2 * 1/2003 Tanaka ..... 399/125
2001/0031162 A1 * 10/2001 Koshimizu et al. ..... 399/405
2002/0061206 A1 * 5/2002 Enomoto et al. ..... 399/124
2002/0196481 A1 * 12/2002 Manabe et al. ..... 358/498
2005/0031371 A1 * 2/2005 Kaida et al. ..... 399/110
2005/0135855 A1 * 6/2005 Park et al. ..... 399/405

FOREIGN PATENT DOCUMENTS

JP 01-074562 A * 3/1989
JP 03-211073 A * 9/1991
JP 05-134501 A * 5/1993
JP 09-189972 7/1997
JP 11-289411 A * 10/1999
JP 2000-221746 8/2000
JP 2000-258971 9/2000
JP 2002-207332 A * 7/2002
JP 2003-101705 4/2003
JP 2003-204410 7/2003
JP 2004-093902 A * 3/2004
JP 2004-191826 A * 7/2004

* cited by examiner

*Primary Examiner*—Sophia S. Chen
(74) *Attorney, Agent, or Firm*—Stanzione & Kim, LLP

(57) ABSTRACT

An image forming apparatus includes a main body having an image forming portion, a scan unit having an image sensor and connected to the main body so as to transmit and receive a signal to and from the main body, and a moving unit disposed at least one of the main body and the scan unit so that the scan unit is relatively moved with respect to the main body. Therefore, a space of a discharged portion formed between the main body and the scan unit can be efficiently utilized, and a jammed paper can be facilely removed.

25 Claims, 8 Drawing Sheets

IMAGE FORMING APPARATUS HAVING SCAN UNIT AND CONTROLLING METHOD THEREOF

CROSS-REFERENCE TO RELATED APPLICATIONS

This application claims benefit under 35 U.S.C. § 119 from Korean Patent Application No. 2004-33309, filed on May 12, 2004, the entire content of which is incorporated herein by reference.

BACKGROUND OF THE INVENTION

1. Field of the Invention

The present general inventive concept relates to an image forming apparatus, and more particularly, to an image forming apparatus having a movable scan unit and a controlling method thereof.

2. Description of the Related Art

Referring to FIG. 1, a conventional image forming apparatus comprises a main body 40 having an image forming portion 42, a scan unit 20 fixedly provided at an upper portion of the main body 40 and a cover 10 disposed at an upper portion of the scan unit 20 so as to open and close the upper portion of the scan unit 20.

The main body 40 comprises a paper cassette 44 for storing papers to be printed, a pick-up roller 52 for picking up the paper stored in the paper cassette 44, a conveying roller 56 for conveying the paper picked up by the pick-up roller 52, a developing unit 60 for forming an image on the paper, a fixing roller 69 for fixing the image on the paper using a high temperature and high pressure, and a discharging roller 72 for discharging the paper on which the image is fixed. Further, there is provided a discharging portion 76 for storing the papers discharged by the discharging roller 72.

An image sensor 24 is disposed in the scan unit 20 to move horizontally for detecting the image and then converting the image into an electric signal. A transparent glass flat plate 28 on which an original document having an image to be scanned is put is provided at an upper side of the scan unit 20. Further, the cover 10 is disposed at the upper portion of the scan unit 20 so as to open and close an upper portion of the glass flat plate 28.

When scanning or copying the document, a user opens the cover 10 and then puts the document on the glass flat plate 28 disposed at the upper side of the scan unit 20. The image of the document is detected by the image sensor 24 and then converted into the electric signal. A laser beam is applied to a photosensitive drum 61 disposed in the developing unit 60 according to the electric signal, thereby forming a latent image. The latent image is transferred to the paper using a high voltage of a transfer roller 64 and then fixed to the paper using the high temperature and high pressure of the fixing roller 69. The paper on which the image is fixed is discharged to the discharging portion 76 by the conveying roller 56.

In the above printing processes, the paper may be jammed in the discharging roller 72, etc. In order to remove the jammed paper, a separate door that can be opened and closed is generally provided.

The discharging portion 76 is provided at an upper side of the main body 40. The discharging portion 76 functions to store the discharged papers and also to cool heat generated from the image forming portion 42 disposed in the main body 40. Therefore, since the discharging portion 76 has to secure a predetermined space, there is a problem in that it is difficult to minimize a size of the image forming apparatus. Further, in a case that a predetermined number of the discharged papers are accumulated in the discharging portion 76, it is inconvenient to periodically remove the accumulated papers from the discharging portion 76 due to a limited space of the discharging portion 76.

SUMMARY OF THE INVENTION

The present general inventive concept provides an image forming apparatus having a scan unit, which is convenient to use, and a controlling method thereof.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing an image forming apparatus which comprises a main body having an image forming portion, a scan unit having an image sensor connected with main body so as to transmit and receive a signal to/from the main body, and a moving unit disposed at least one of the main body and the scan unit so that the scan unit is relatively moved with respect to the main body.

The moving unit may be at least one or more link unit having a link member and a hinge unit.

The link unit may further comprise a stopper to stop the scan unit in a predetermined height from the main body.

The moving unit may be at least one or more sliding unit having a rail member and a rail groove corresponding to the rail member so that the scan unit can be slidingly moved on the main body.

The moving unit may be at least one or more cylinder unit having a cylinder and a piston to move the scan unit upward and downward.

The image forming apparatus may comprise a discharging portion formed at an upper portion of the main body to store the discharged papers.

The image forming apparatus may further comprise a driving portion to move the moving unit, a sensor to detect information about whether the moving unit needs to be moved, and a controlling portion to control the driving portion according to the information detected from the sensor.

The information may be at least one of first information about a paper jam and second information about an amount of discharged papers.

The image forming apparatus may further comprise a scan unit position detecting sensor disposed at least one of the scan unit and the main body to detect a position of the scan unit.

The foregoing and/or other aspects and advantages of the present general inventive concept may also be achieved by providing a method of controlling an image forming apparatus having a scan unit, the method comprising detecting information about whether the moving unit needs to be moved, determining whether the moving unit needs to be moved according to the detected information, and moving the scan unit.

The detected information may be at least one of first information about a paper jam and second information about discharged papers.

The controlling method may further comprise detecting a position of the scan unit.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
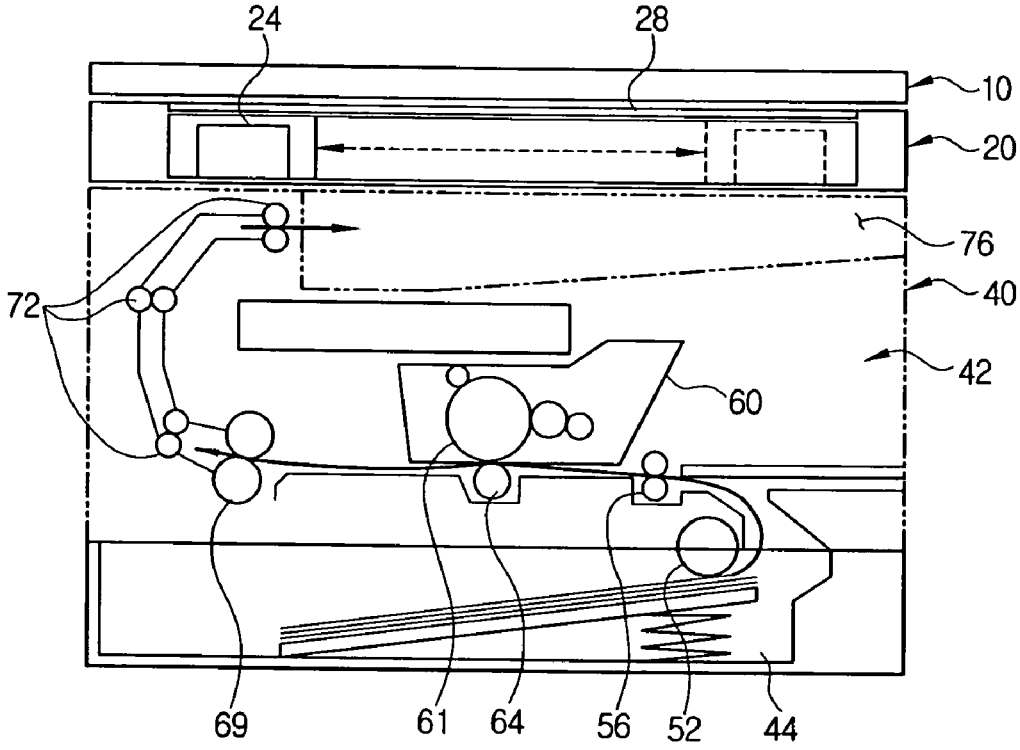
FIG. 1 (PRIOR ART)
FIG. 1 is a cross-sectional view showing a conventional image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures. A moving unit that will be described in below is realized as a link unit 200 in FIGS. 2-4, a sliding unit 400 in FIGS. 7 and 8, and a cylinder unit 600 in FIGS. 9 and 10.

Figure 2:
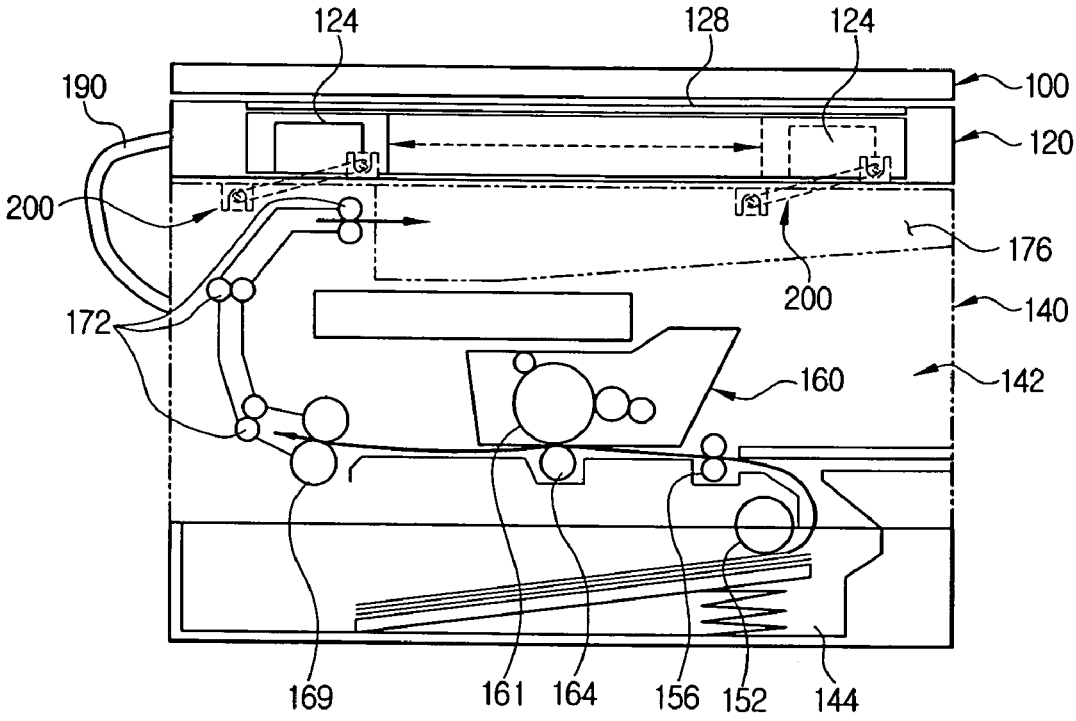
FIG. 2 is a cross-sectional view showing an image forming apparatus according to an embodiment of the present general inventive concept.

Referring to FIG. 2, an image forming apparatus according to an embodiment of the present general inventive concept comprises a main body 140 in which an image forming portion 142 is disposed, a scan unit 120 which is movably disposed in the main body 140, a connecting wire 190 to transmit a signal and supply power between the main body 140 and the scan unit 120, a cover 100 disposed at an upper side of the scan unit 120 to move with respect to the scan unit so as to open and close the scan unit 120, and a moving unit (200: hereinafter, called as a 'link unit', a 'sliding unit' or a 'cylinder unit) disposed at the main body 140 and the scan unit 120 so as to move the scan unit 120 with respect to the main body 140.

The main body 140 comprises a paper cassette 144 to store papers to be printed, a pick-up roller 152 to pick up the paper stored in the paper cassette 144, a conveying roller 156 to convey the paper picked up by the pick-up roller 152, a developing unit 160 to form an image on the paper, a fixing roller 169 to fix the image on the paper using a high temperature and a high pressure, and a discharging roller 172 to discharge the paper on which the image is fixed. Further, at an upper portion of the main body 140, there is provided a discharging portion 176 to store the papers discharged by the discharging roller 172.

An image sensor 124 is disposed in the scan unit 120 to move horizontally to detect the image and then convert the image into an electric signal. A transparent glass flat plate 128 on which an original document having an image to be scanned is put is provided at an upper side of the image sensor 124. The image sensor 124 is to detect the image of the document to be scanned and then convert the detected image into an electrical signal. The image sensor 124 performs a scanning operation while moving frontward and backward. A CCD (Charge Coupled Device), etc., can be used as the image sensor 124.

The connecting wire 190 connects the main body 140 with the scan unit 120 so as to transmit and receive the electrical signal between the main body 140 and the scan unit 120 and also to supply the power from the main body 140 to the scan unit 120. The connecting wire 190 may have a sufficient length so that the scan unit 120 can be freely moved with respect to the main body 140.

The cover 100 is disposed at the upper portion of the scan unit 120 so as to open and close an upper portion of the glass flat plate 128, so that the document to be scanned can be put on the glass flat plate 128 provided at an upper side of the scan unit 120.

The link unit 200 is rotatably disposed at the upper portion of the main body 140 and a lower portion of the scan unit 120. By the link unit 200, the scan unit 120 can be moved and then apart from the main body 140. The detailed description will be provided in below.

In an operation of the image forming apparatus, a user opens the cover 100 and then puts the document on the glass flat plate 128 disposed at the upper side of the scan unit 120. The image of the document is detected by the image sensor 124 and then converted into the electrical signal. A laser beam is applied to a photosensitive drum 161 rotatably disposed in the developing unit 160 according to converted data of the electrical signal, thereby forming a latent image. The latent image is transferred to the paper using a high voltage of a transfer roller 164 and then fixed to the paper using the high temperature and high pressure of the fixing roller 169. The paper on which the image is fixed is discharged to the discharging portion 176 by the discharging roller 172. At this time, in a case that a large amount of the discharged papers is accumulated in the discharging portion 176 or the paper is jammed in the discharging roller 172, etc., the user moves the scan unit 120 to be apart from the main body 140. Thus, the upper side of the discharging portion 176 is opened. A movement of the scan unit 120 secures an upper space of the discharging portion 176 so that a larger number of the discharged papers can be accumulated in the discharging portion 176. Furthermore, the jammed paper can be facilely removed through the space formed between the scan unit 120 and the main body 140. The movement of the scan unit 120 is interlocked with a rotation of the link unit 200 disposed at the main body 140 and the scan unit 120.

Figure 3A:
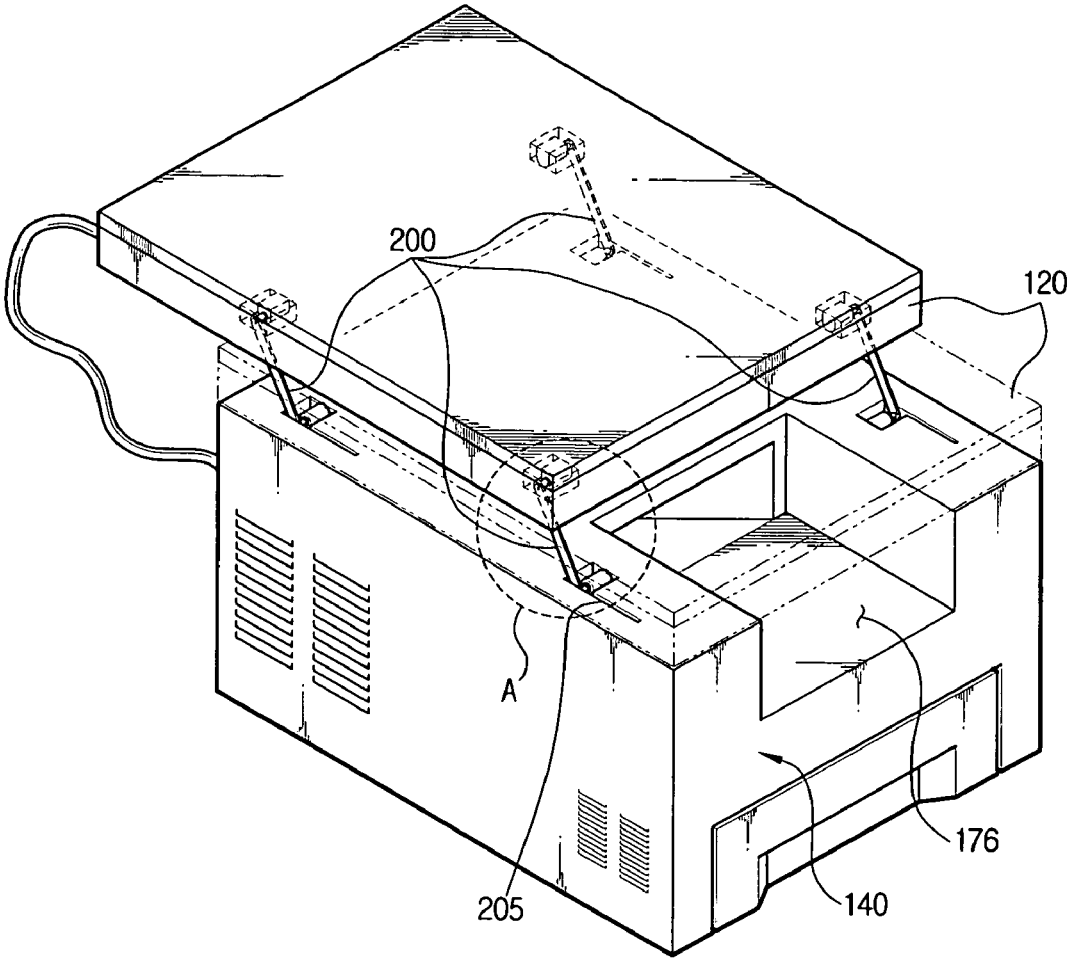
FIG. 3A is a perspective view showing a status that a scan unit of the image forming apparatus of FIG. 2 is moved.
Figure 3B:
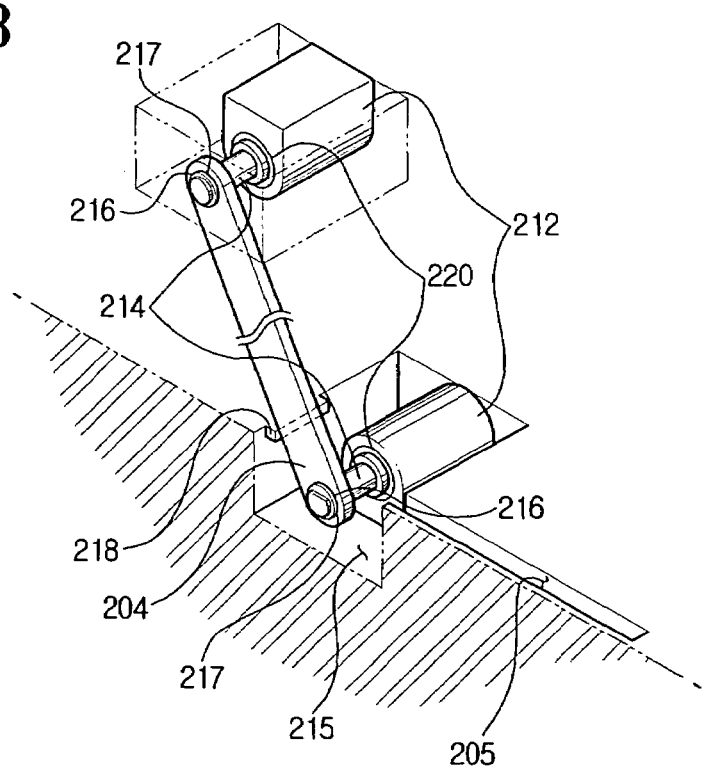
FIG. 3B is an enlarged view of a portion A of FIG. 3A.

FIG. 3A is a perspective view showing a status in which the scan unit 120 is moved and apart from the main body 140, and FIG. 3B is an enlarged view of a portion A of FIG. 3A.

Referring to FIGS. 3A and 3B, the link unit 200 comprises a hinge unit mounting portion 215 formed in the main body 140, a hinge housing 212 fixed to the hinge unit mounting portion 215, a hinge shaft 214 rotatably disposed in the hinge housing 212, a bearing 220 to rotatably support the hinge shaft 214 in the hinge housing 212, a link member 204 of which each end has a hole 217 through which the hinge shaft 214 is coupled to the link member 204, a separation preventing pin 216 to prevent the link member 204 from being separated from the hinge shaft 214, a link member receiving portion 205 formed in the main body 140 to receive the link member 204, and a stopper 218 formed in the main body 140 to stop the scan unit 120 at a predetermined height with respect to the main body 140.

The hinge unit mounting portion 215 is formed in an upper portion of the main body 140 and a lower portion of the scan unit 120. The hinge housing 212 is fixedly disposed in the hinge unit mounting portion 215. The hinge shaft 214 supported by the bearing 220 is rotatably disposed in the hinge housing 212. The hole 217 is formed at each of both ends of the link member 204. Each of the hinge shaft 214 provided in the lower portion of the scan unit 120 and the upper portion of the main body 140 is inserted into the hole 217. The separation preventing pin 216 is provided at an end of each hinge shaft 214, so that the link member 204 is prevented from being separated from the hinge shaft 214. Further, the stopper 218 is formed at the hinge unit mounting portion 215 formed at the upper portion of the main body 140. A rotation of the hinge shaft 214 can be stopped by the stopper 218, after the scan unit 120 is moved to the predetermined height.

When a large amount of the discharged papers is accumulated in the discharging portion 176 or the paper is jammed in the discharging roller 172, etc., a user moves the scan unit 120. The movement of the scan unit 120 is interlocked with the rotation of the link unit 200 of which one end is rotatably coupled to the scan unit 120. Due to the movement of the scan unit 120, the upper portion of the discharging portion 176 is opened, so that an upper space of the discharging 176 can be secured and the jammed paper is also removed through a space between the scan unit 120 and the main body 140.

In FIGS. 4 to 10, each member also shown in FIGS. 1 to 3B is identified by the same reference numeral and the description thereof will be omitted herein.

Figure 4:
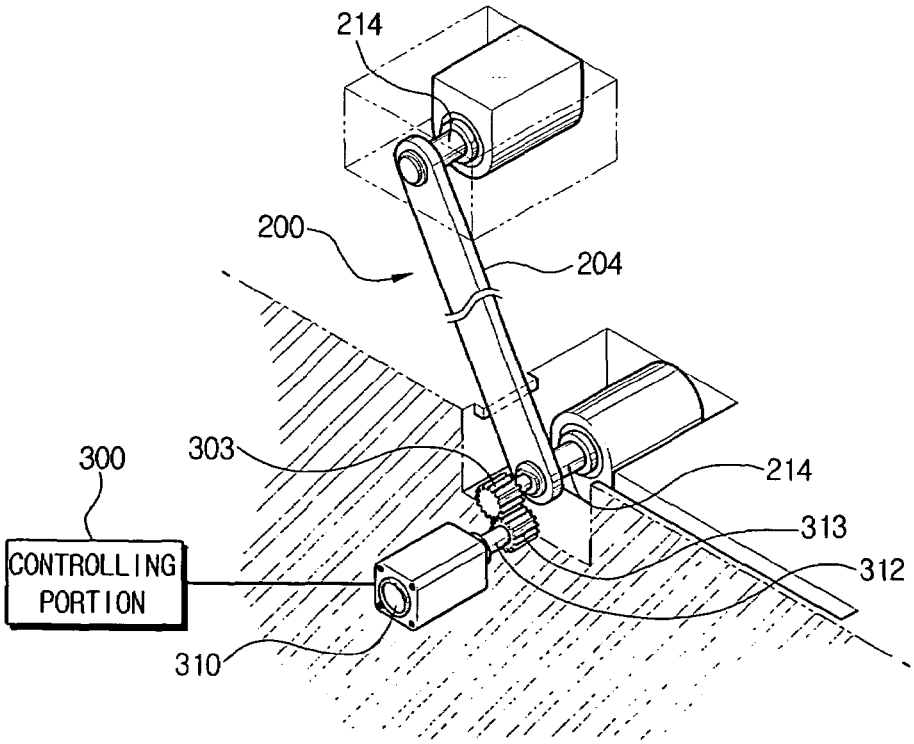
FIG. 4 is a perspective view showing a link unit of an image forming apparatus according to another embodiment of the present general inventive concept.
Figure 5:
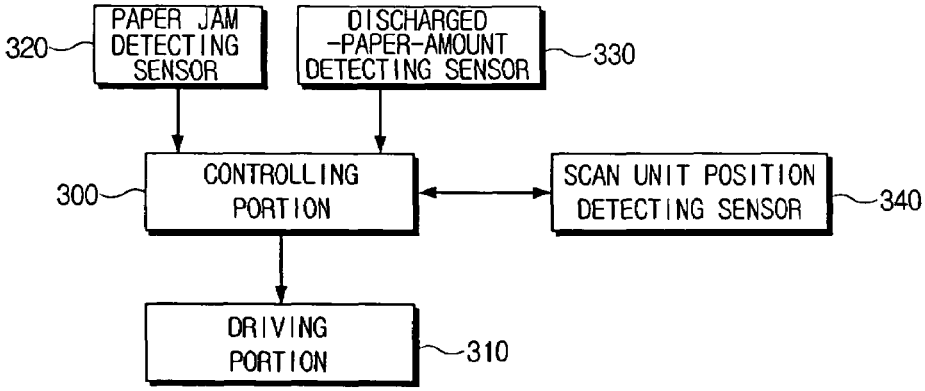
FIG. 5 is a block diagram showing a method of controlling the image forming apparatus of FIG. 4.
Figure 6:
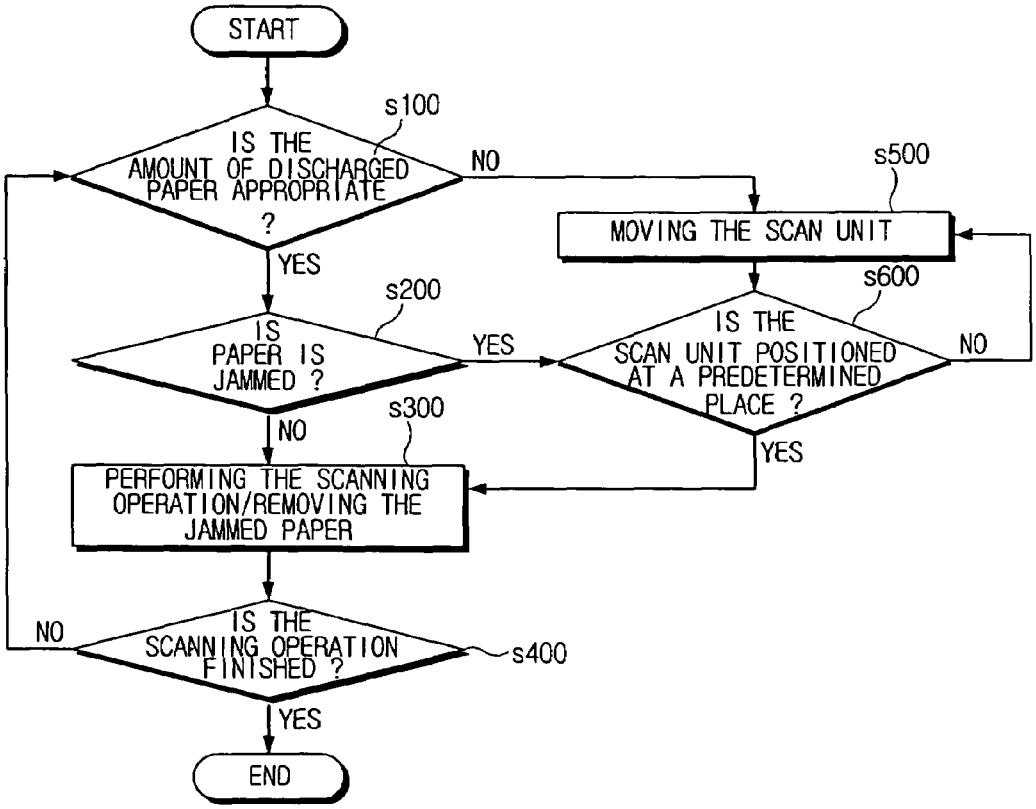
FIG. 6 is a flow chart showing the method of controlling the image forming apparatus of FIGS. 4 and 5.

FIG. 4 is a perspective view of a link unit 200 of an image forming apparatus according to another embodiment of the present general inventive concept, and FIGS. 5 and 6 are a block diagram of the image forming apparatus of FIG. 4 and a flow chart showing a controlling method of moving a scan unit 120 in the image forming apparatus of FIGS. 4 and 5.

Referring to FIGS. 4 and 5, the image forming apparatus comprises a discharged-paper-amount detecting sensor 330 to detect an amount of the discharged papers, a paper jam detecting sensor 320 to detect a paper jam, a driving portion 310, such as a motor, etc., to drive the link unit 200, a controlling portion 300 to control the driving portion 310 according to information obtained from the discharged-paper-amount detecting sensor 330 or the paper jam detecting sensor 320, and a scan unit position detecting sensor 340 to detect a position of the scan unit 120.

At a driving shaft of the driving portion, there is provided a driving gear 313. At a hinge shaft 214, there is provided a driven gear 303 which has a predetermined gear ratio with respect to the driving gear 313 and also corresponds to the driving gear 313. If the driving shaft 312 is rotated, a rotational force is transmitted through the driving gear 313 and the driven gear 303 to the hinge shaft 214. Thus, the hinge shaft 214 is rotated by the transmitted rotational force. If the hinge shaft 214 is rotated, a link member 204 is circulated (rotated) around the hinge shaft 214 and thus the scan unit 120 (referring to FIG. 2) is moved with respect to the main body 140. Therefore, the scan unit 120 is apart from the main body 140 (referring to FIG. 2). Furthermore, if the user controls the scan unit 120 to be in contact with the main body 140, the above processes are reversely performed.

The paper jam detecting sensor 320 and the discharged-paper-amount detecting sensor 330 detect information about the jammed paper and the amount of the discharged papers, respectively, and then transmit the information to the controlling portion 300. The controlling portion 300 controls the driving portion 310 according to the information. At this time, if the scan unit 120 is moved by the driving portion 310, information about the position of the scan unit 120 is transmitted from the scan unit position detecting sensor 340 to the controlling portion 300. Hereinafter, the controlling method will be fully described with reference to FIG. 6.

Referring to FIG. 6, it is determined whether the amount of the discharged papers is appropriate (S100). The operation S100 is performed in the controlling portion 300 (referring to FIG. 5) by comparing the information transmitted from the discharged-paper-amount detecting sensor 330 (referring to FIG. 5) with a preset value.

If the amount of the discharged papers is appropriate, it is determined whether the paper is jammed (S200). If the paper jam is not occurred, a scanning operation is performed (S300). Then, it is determined whether the scanning operation is finished (S400). If the scanning operation is not finished, it is again returned to the S100 in which it is determined whether the amount of the discharged papers is appropriate. If the paper jam is occurred, the scan unit 120 is moved (S500). While the scan unit 120 is moved, it is determined whether the scan unit 120 is arrived at a predetermined place (S600). The operation S600 is performed in the controlling portion 300 by the information obtained from the scan unit position detecting sensor 340. If the scan unit 120 is not arrived at the predetermined position, the S500 in which the scan unit 120 is moved is again performed. If the scan unit 120 is arrived at the predetermined position, the jammed paper is removed (S300). After the jammed paper is removed, the operation S400 in which it is determined whether the scanning operation is finished is performed.

If the amount of the discharged papers is not appropriate, that is, the amount of the discharged papers is greater than a reference amount, the operation S500 is performed to move the scan unit 120, and the operation S600 is performed to determine whether the scan unit 120 is arrived at the predetermined place. The operation S300 is performed to carry out the scanning operation.

As described above, the movement of the scan unit 120 can be automatically realized.

Figure 7:
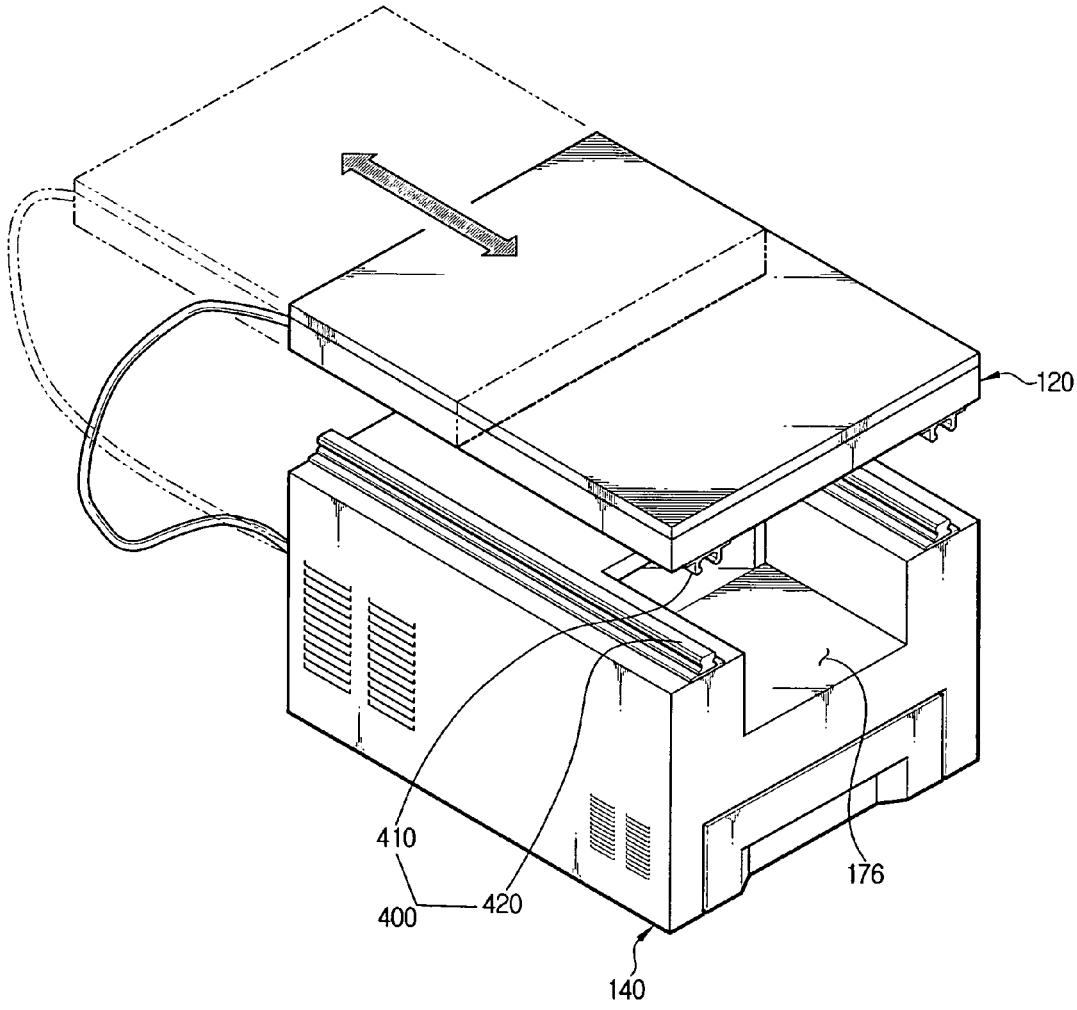
FIG. 7 is a perspective view showing an image forming apparatus according to another embodiment of the present general inventive concept.

FIG. 7 is a perspective view showing an image forming apparatus according to another embodiment of the present general inventive concept.

Referring to FIG. 7, a sliding unit 400 is used as the moving unit 200. the sliding unit 400 comprises a rail groove 410 formed at a lower portion of the scan unit 120, and a rail member 420 formed at an upper portion of the main body 140 to correspond to the rail groove 410. Due to the rail groove 410 and the rail member 420, the scan unit 120 can be slid on the main body 140. The upper portion of the discharging portion 176 is opened according to the sliding of the scan unit 120, so that a space of the discharging portion 176 can be widely secured. The rail groove 410 and the rail member 420 may be reversely disposed.

Figure 8:
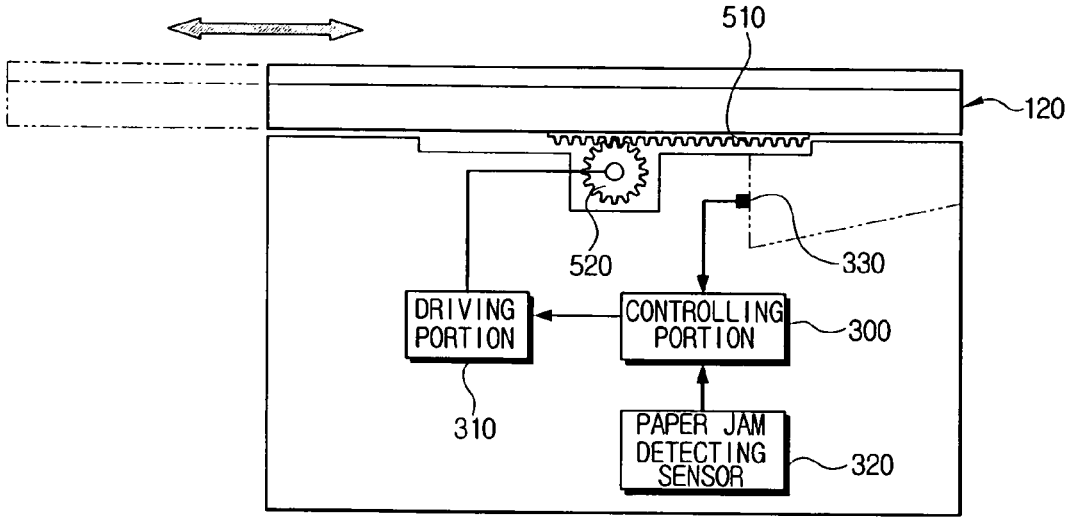
FIG. 8 is a cross-sectional view showing an image forming apparatus according to another embodiment of the present general inventive concept.

FIG. 8 is a cross-sectional view of an image forming apparatus according to another embodiment of the present general inventive concept.

Referring to FIG. 8, a rack gear 510 is disposed at the lower portion of the scan unit 120, and a pinion gear 520 is rotatably disposed at the upper portion of the main body 140 so as to correspond to the rack gear 510. Also, the rack gear 510 and the pinion gear 520 may be disposed on the main body 140 and the scan unit 120, respectively. The rack gear 510 and the pinion gear 520 are driven by the driving portion 310. The driving portion 310 is controlled by the controlling portion 300 according to the information obtained from the paper jam detecting sensor 320 and the discharged-paper-amount detecting sensor 330. The controlling method thereof is the same as in the second embodiment. Therefore, the scan unit 120 can be automatically slid.

Figure 9:
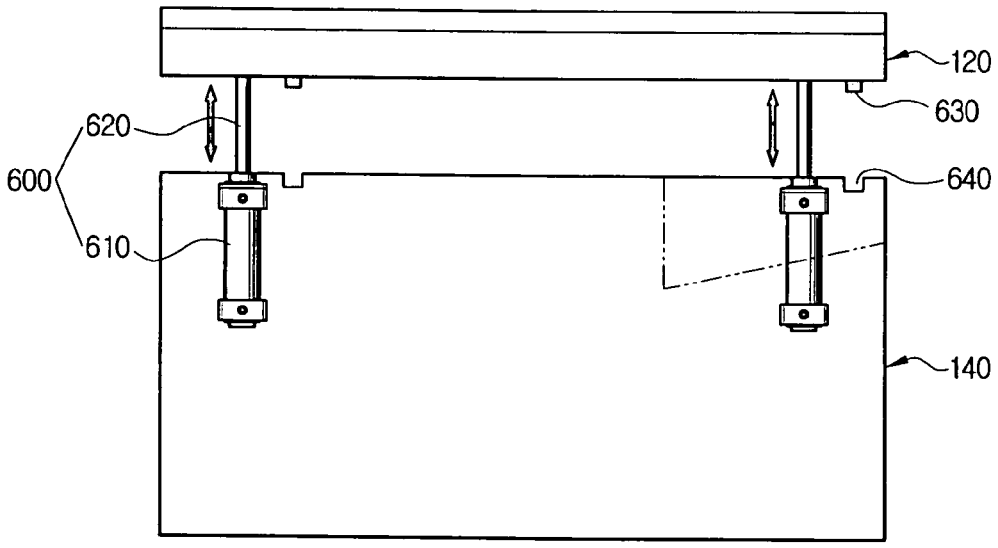
FIG. 9 is a cross-sectional view showing an image forming apparatus according to another embodiment of the present general inventive concept.

FIG. 9 is a cross-sectional view of an image forming apparatus according to another embodiment of the present general inventive concept.

Referring to FIG. 9, the image forming apparatus comprises a cylinder unit 600, a hook 630 and a hook groove 640. The cylinder unit 600 comprises a cylinder 610 and a piston 620 disposed in the cylinder 610 so as to reciprocate upward and downward. The cylinder unit 600 is well known in the car industry, etc. Thus, the description thereof will be omitted.

When the scan unit 120 is in contact with the main body 140, the piston 620 is positioned in the cylinder 610 and maintained in a compressed and locked condition by a coupling between the hook 630 disposed at the lower portion of the scan unit 120 and the hook groove 640 disposed at the upper portion of the main body 140. However, if the scan unit 120 needs to move away from or move with respect to the main body 140, because of the paper jam or the discharged papers, the user releases the hook 630 and the hook groove 640 from a locking state to an unlocking state. Thus, the piston 620 compressed in the cylinder 610 pushes up the scan unit 120. Since a construction for releasing the locking state is already well know, a description thereof will be omitted.

Figure 10:
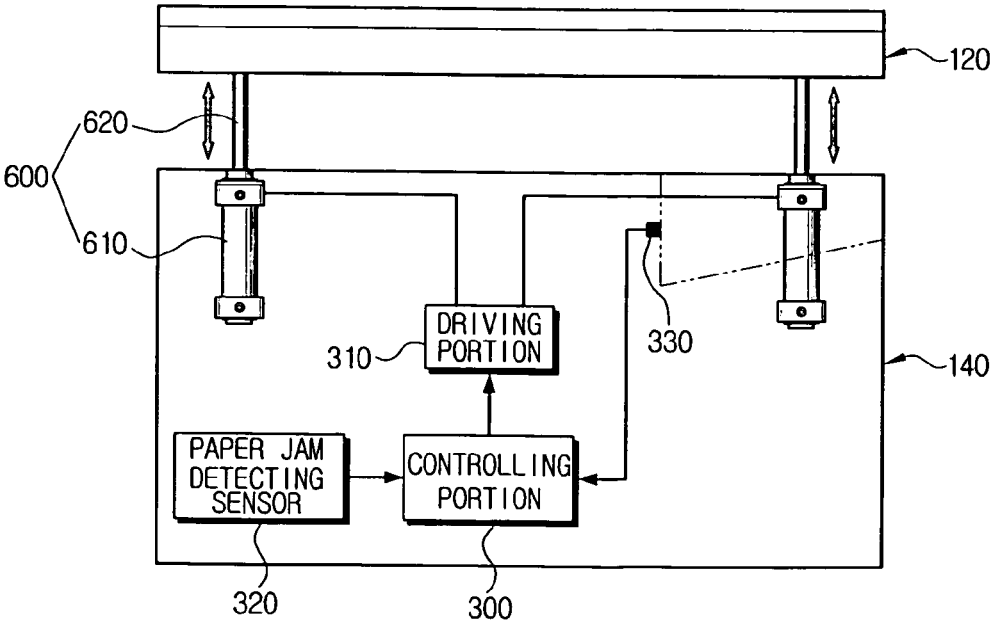
FIG. 10 is a cross-sectional view showing an image forming apparatus according to another embodiment of the present general inventive concept.

FIG. 10 is a cross-sectional view of an image forming apparatus according to another embodiment of the present general inventive concept.

Referring to FIG. 10, the image forming apparatus according to the sixth embodiment comprises a cylinder unit 600, a driving portion 310 for driving the cylinder unit 600, a controlling portion 300 for controlling the driving portion 310, a paper jam detecting sensor 320 for providing information about a paper jam to the controlling portion 300, and a discharged-paper-amount detecting sensor 330 for providing information about discharged papers to the controlling portion 300. A pump, etc., can be used as the driving portion 310 to supply a pressure to the cylinder unit 600. Accordingly, when the paper jam is occurred or the discharged papers are excessively stacked, due to the above construction, the controlling portion 300 drives the driving portion 310 so that the scan unit 120 can be automatically apart from the main body 140.

According to the image forming apparatus having the scan unit according to the present general inventive concept, as described above, since the scan unit can be moved from the main body, the space of the discharging portion can be efficiently utilized. Further, since a space for exhausting the heat generated from the main body to an outside can be secured, a cooling efficiency can be improved. Furthermore, when the paper jam is occurred, the jammed paper can be facilely removed.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a main body having an image forming portion to form an image on a paper and to discharge the paper on which the image is formed;

a scan unit having an image sensor and connected to the main body so as to transmit and receive a signal to and from the main body; and a moving unit disposed between the main body and the scan unit so that the scan unit is relatively moved with respect to the main body while maintaining a parallel relationship.

2. The apparatus of claim 1, wherein the moving unit comprises at least one link unit which has a link member and a hinge unit.

3. The apparatus of claim 2, wherein the link unit further comprises a stopper to stop the scan unit at a predetermined height from the main body.

4. The apparatus of claim 1, wherein the moving unit comprises at least one sliding unit which has a rail member formed on one of the main body and the scan unit and a rail groove formed on the other one of the main body and the scanning unit to correspond to the rail member so that the scan unit can be slidingly moved with respect to the main body.

5. The apparatus of claim 1, wherein the moving unit comprises at least one cylinder unit which has a cylinder and a piston to move the scan unit upward and downward.

6. The apparatus of claim 1, further comprising:

a discharging portion formed at an upper portion of the main body to store the discharged paper.

7. The apparatus of claim 1, further comprising:

a driving portion to move the moving unit;

a sensor to detect information about whether the moving unit needs to be moved; and a controlling portion to control the driving portion according to the information detected from the sensor.

8. The apparatus as claimed in claim 7, wherein the information comprises at least one of first information about a paper jam and second information about an amount of discharged papers.

9. The apparatus as claimed in claim 8, further comprising:

a scan unit position detecting sensor disposed at at least one of the scan unit and the main body to detect a position of the scan unit with respect to the main body.

10. An image forming apparatus, comprising:

a main body having an image forming portion to form an image on a paper and discharge the paper, and a discharging portion formed on a surface of the main body to receive the discharged paper; and a scan unit having an image sensor, disposed on the main body so that the discharging portion is disposed between the scan unit and the surface of the main body, and to move vertically apart with respect to the main body while maintaining a parallel relationship.

11. The apparatus as claimed in claim 10, further comprising:

a cover connected to the scan unit to receive a document so that the image sensor scans the document and outputs a signal corresponding to the image to the image forming portion of the main body, wherein the cover and the scan unit move together with respect to the main body.

12. The apparatus as claimed in claim 10, wherein the scan unit moves with respect to the main body to provide an additional space to the discharging portion.

13. The apparatus as claimed in claim 10, wherein the scan unit covers a second surface of the main body and moves between a first position and a second position with respect to the main body to uncover at least a portion of the second surface of the main body.

14. The apparatus as claimed in claim 10, further comprising:

a sensor to detect one of a paper jam of the main body and a status of the discharged paper, wherein the scan unit moves with respect to the main body according to the detection of the sensor.

15. The apparatus as claimed in claim 14, wherein the sensor is installed in the main body, and the scan unit moves to expose at least a portion of the surface of the main body.

16. A method of controlling an image forming apparatus having a main body and a scan unit, the method comprising:

providing a main body which includes an image forming portion to form an image on a paper and discharge the paper, and a discharging portion formed on a surface of the main body to receive the discharged paper; and moving a scan unit, which includes an image sensor and is disposed on the main body so that the discharging portion is disposed between the scan unit and the surface of the main body, vertically apart with respect to the main body while maintaining a parallel relationship.

17. A method of controlling an image forming apparatus having a main body and a scan unit, comprising:

detecting information about whether a moving unit needs to move a scan unit having an image sensor with respect to a main body having an image forming portion;

determining whether the moving unit needs to be moved according to the detected information; and moving the scan unit while maintaining a vertical relationship with respect to the main body according to a movement of the moving unit.

18. The method as claimed in claim 17, wherein the detected information comprises at least one of first information about a paper jam and second information about discharged papers.

19. The method of claim 18, further comprising:

detecting a position of the scan unit, wherein the moving of the scan unit comprises moving the scan unit according to the detected portion of the scan unit.

20. An image forming apparatus, comprising:

a main body having an image forming portion to form an image on a paper and to discharge the paper on which the image is formed;

a discharging portion formed at an upper portion of the main body to store the discharged paper;

a scan unit having an image sensor and connected to the main body so as to transmit and receive a signal to and from the main body; and a moving unit disposed between the main body and the scan unit to move the scan unit with respect to the main body while maintaining a parallel relationship, wherein the scan unit moves to provide an additional space to the discharging portion or to allow removal of paper jam.

21. The apparatus of claim 20, wherein the moving unit comprises at least one link unit which has a link member and a hinge unit.

22. The apparatus of claim 21, wherein the link unit further comprises a stopper to stop the scan unit at a predetermined height from the main body.

23. The apparatus of claim 20, wherein the moving unit comprises at least one sliding unit which has a rail member and a rail groove corresponding to the rail member so that the scan unit can be slidingly moved with respect to the main body.

24. The apparatus of claim 20, wherein the moving unit comprises at least one cylinder unit which has a cylinder and a piston to move the scan unit upward and downward.

25. An image forming apparatus, comprising:

a main body having an image forming portion to form an image on a paper and discharge the paper, and a discharging portion formed on a surface of the main body to receive the discharged paper; and a scan unit having an image sensor, disposed on the main body above the discharge portion, to move with respect to the main body while maintaining a parallel relationship to provide an additional space to the discharging portion or to allow removal of paper jam.

* * * * *